US005835119A

United States Patent [19]

Samuels

[11] Patent Number: 5,835,119

[45] Date of Patent: Nov. 10, 1998

[54] FACE EMITTING ELECTROLUMINESCENT EXPOSURE ARRAY

[75] Inventor: Brian C. Samuels, Fremont, Calif.

[73] Assignee: Hewlett- Packard Company, Palo Alto, Calif.

[21] Appl. No.: 551,235

[22] Filed: Oct. 31, 1995

[51] Int. Cl.[6] ..... B41J 2/45; B41J 2/385

[52] U.S. Cl. ..... 347/238; 347/130

[58] Field of Search ..... 347/238, 130; 257/53, 57, 84; 385/54, 66; 315/169.3; 372/45

[56] References Cited

U.S. PATENT DOCUMENTS

| | | | |
|---|---|---|---|
| 4,435,064 | 3/1984 | Tsukuda et al. | 347/130 |
| 4,535,341 | 8/1985 | Kun | 346/107 |
| 4,980,700 | 12/1990 | Ng | 347/241 |
| 5,252,895 | 10/1993 | Leksell et al. | 313/506 |
| 5,325,207 | 6/1994 | Leksell et al. | 358/296 |
| 5,325,277 | 6/1994 | Suzuki et al. | 362/84 |
| 5,341,195 | 8/1994 | Satoh | 355/237 |
| 5,363,240 | 11/1994 | Miyashita | 359/625 |

FOREIGN PATENT DOCUMENTS

| | | |
|---|---|---|
| 446746 | 9/1991 | European Pat. Off. . |
| 42 35 167 A | 4/1993 | Germany . |
| 42 21 949 A | 1/1994 | Germany . |
| 2 262 069 | 6/1993 | United Kingdom . |

OTHER PUBLICATIONS

Patent Abstracts of Japan, vol. 011, No. 377, Dec. 9, 1987, & JP 62 149 465 A, Light Emitter, Jul. 3, 1987, Fuji Xerox Co. Ltd.

*Primary Examiner*—N. Le
*Assistant Examiner*—Thinh Nguyen
*Attorney, Agent, or Firm*—Denise A. Lee

[57] ABSTRACT

The present invention provides a face emission printing system including an array of face emission electroluminescent devices coupled to an optical structure. The face emission EL printhead is comprised of a substrate; and a plurality of layer stack supported on the substrate, each of the layer stack including a thin film active layer which generates light in response to conduction of electrical current, a first thin film electrode layer and a second thin film electrode layer, where at least one of said electrode layers being spaced apart from said active layer by a thin film dielectric layer. The first thin film electrode layer is transparent and light is emitted through the surface of the first thin film electrode layer. The layer stacks are preferably staggered and the optical structure is preferably a micro lens are optical concentrator formed integral to the emitting surface of the plurality of layer stacks.

12 Claims, 3 Drawing Sheets

FACE EMITTING ELECTROLUMINESCENT EXPOSURE ARRAY

BACKGROUND OF THE INVENTION

The present invention relates to electroluminescent devices and in particular face emission electroluminescent devices used in image recording devices.

Thin film electroluminescent devices are employed in a variety of applications. For example, an array of electroluminescent (EL) devices can be used to form a printhead or used in a facsimile machine. U.S. Pat. No. 4,535,341 to Kun et al. describes an array of thin film electroluminescent devices in a printhead, the EL devices emitting along an edge perpendicular to the common and control electrodes. U.S. Pat. No. 5,325,207 to Leksell et al. describes an array of edge emitting electroluminescent devices used in a facsimile machine for spot scanning.

FIG. 1 shows an edge emitting EL device 100 comprised of an active semiconductor layer 110 sandwiched between two dielectric layers 112, 114. Electrode layers 116, 118 are formed on the surface of the dielectric layers 112, 114 opposite to the active semiconductor layer 110. Electroluminescence occurs in the active semiconductor layer 110 when the potential difference between the two electrode layers 116, 118 reaches a threshold voltage.

In the past, the focus has been strongly on the use of edge emitting EL device applications for printing/faxing. Edge emitting EL devices have the desirable property of emitting from an edge, a thin layer (approximately 1 micron) of phosphor. Further, the length of the edge emitting array can be easily defined by the user to the desired length and further individually addressable pixels may be defined by fabricating along this length. Applicant believes that edge emitting devices have been preferred in the past because as stated in Kun et al., edge emission devices are typically 30 to 40 times brighter than conventional face emission devices. However, there are problems associated with the manufacturing edge emitting EL devices. Some of these problems relate to the overall cost of manufacturing an emitting array and lens assembly.

Referring to FIG. 1, the active semiconductor layer 110 is positioned between two dielectric layers 112, 114. Typically, the active semiconductor layer 110 is ZnS doped with manganese while the dielectric layers 112, 114 are comprised of silicon oxinitride (SiON). There are difficulties in manufacturing an optically simple and electrically stable ZnS edge whose emitting surface is aligned perpendicular to a first major surface of the electrode layer 120. FIG. 1 shows what is typically thought to be the ideal ZnS active layer edge where the plane of the emitting edge and the plane of the dielectric layers are both aligned perpendicular to the first major surface of the electrode layer. It is difficult however to etch an "ideal" ZnS edge and typically the ZnS edge 124 and the glass substrate ledge 126 extend past the plane of the edge of the dielectric layers, adversely affecting the optical properties of the edge emitting device. Further, the optical properties of the edge emitting devices may be adversely effected by light reflecting off the glass ledge. These added complexities to the optical properties of the emitted light effect the ability to couple light into the lens array 130.

In a standard edge emitting printhead, the edge emitting devices are positioned in a single row. Use of a single conventional lens in combination with an edge emitting array is impractical since a conventional lens properly sized to center the sweet spot of the lens along the light emitting edge would impose unacceptable size requirements on the printhead. The sweet spot of the lens is the area of the lens where the optical distortion of the lens produced is within specified limits. Further alternatives to conventional lenses are the roof lens mirror array described in U.S. Pat. No. 5,363,240 to Miyashita and the gradient index rod lens array sometimes referred to as a Selfoc lens array. Both are refractive lens arrays that image more than one pixel an are typically placed a predetermined distance from the light source. The roof lens mirror array described in U.S. Pat. No. 5,363,240 has the disadvantages of being optically complex and difficult to align. The Selfoc lens, which has been used in combination with an edge emitting printhead, although easy to align, is expensive.

Image quality is in part related to the number of dots per inch. In edge emitting devices, increasing the number of dots per inch is limited in part by the number of edge emitting devices and the spacing between them in the row. Increasing the number of the edge emitting devices also requires increasing the number of electrical interconnections. Currently the number of dots per inch is limited by semiconductor processing, the spacing required to provide optical isolation, and the availability of lenses that can image closely spaced emitters, and other system related constraints.

A problem with edge emitting devices is that optical isolation of pixels is difficult. Optical isolation of adjacent pixels is important to prevent optical cross talk. Solutions to optical cross talk are known. FIG. 1 of U.S. Pat. No. 5,252,895 to Leksell shows a series of longitudinal channels 20 and a transverse street 32 which serve to optically isolate adjacent pixels in the edge emitter array. Although, the configuration shown in Leksell decreases optical cross talk, the addition of these longitudinal channels 20 add processing steps, increasing manufacturing complexity and costs.

U.S. Pat. No. 5,341,195 to Satoh describes an electrophotographic printer that uses a surface emitting electroluminescent imaging head. The surface emitting electroluminescent elements are arranged in two arrays; a first array for imaging in the fast scan direction and a second array for imaging in the slow scan direction. The EL elements in the first array and second array have different dimensions wherein the dimensions of the elements in the slow scan direction are greater than the elements in the fast scan direction. It is Applicant's understanding of the Satoh reference that a pair of corresponding elements in the first and second array are used to image a single pixel. The elements appear to be positioned immediately behind each other thus increasing difficulties related to optical isolation and heat dissipation.

A printhead that reduces manufacturing complexity, decreases reliance on particular lens system, reduces optical cross-talk and increases the amount of space available for device interconnect is needed.

SUMMARY OF THE INVENTION

The present invention provides a face emission printhead that reduces manufacturing complexity, decreases reliance on particular lens system, reduces optical cross-talk and increases the amount of space available for device interconnect and heat dissipation. The present invention is a face emission printing system including an array of face emission electroluminescent devices coupled to an optical structure. The face emission EL printhead is comprised of a substrate; and a plurality of layer stacks supported on the substrate, each of the layer stacks including a thin film active layer which generates light in response to conduction of electrical current, a first thin film electrode layer and a second thin film electrode layer, where at least one of said electrode layers is spaced apart from said active layer by a thin film dielectric layer. The first thin film electrode layer is transparent and light is emitted through the surface of the first thin film electrode layer, in contrast to standard edge emitting device which light is emitted primarily from the edge perpendicular to the first and second film electrodes. Typically, the emitted light is optically coupled to an optical structure, the optical structure preferably formed on the surface of the plurality of layer stacks. Further the plurality of layer stacks are typically staggered to maximize the area available for placement of the integral lens systems.

The face emission printing system reduces design and manufacturing complexity. Because the emphasis is on face emitted light and not the edge emitted light, the difficult step of etching a high quality ZnS active layer that is substantially perpendicular with the dielectric layers is eliminated. Further, printing engine design is simplified in part because the complex light emission properties resulting from the non-ideal ZnS edges and glass ledges are eliminated.

Further, the amount of space available for placement of the emitting region is increased in face emission printheads. In conventional edge emitting array, the area available for placement of the emitting region is defined by the boundary of the active region along the plane generally perpendicular to the first and second electrode layers. For an emitting array designed to image an 8½ inch recording media, this area typically has a width of approximately 8½ inches and a thickness (the plane perpendicular to the first and second electrode regions) of approximately 1 micron. To achieve an exposure resolution of approximately 300 dpi, each edge emitting device in the array is approximately 80 microns. Because of the necessity to use the light emitted from the thin dimension of the edge emitting devices, the devices must be aligned in a single row along the 8½ inch width of the print array.

In contrast, in a conventional face emitting array, the area available for placement of the emitting region is limited only by the substrate surface area which can be quite large. The active region is defined by the boundary of the active region along the plane generally parallel to the first and second electrode regions. The active regions may be placed in any logical arrangement across the surface of the substrate that deliver the required dpi exposure resolution on the recording device. This is in stark contrast to the edge emitting design which is forced to be arrayed along one edge of the substrate. Further, it is believed that the area of the emitting pixel can be expanded without significantly effecting the light transmission characteristics of the array and without imposing unacceptable size requirements on the printhead. For a dot size that has the same dimensions as a dot in the edge emitting array (300 dpi), a face emission array offers increased space available for pixel placement and device interconnect, and allows for reduced optical cross-talk and improved heat dissipation. Heat dissipation is important since the substrate, typically glass, does not dissipate heat well, so that current edge emitting devices which are spaced closely together cannot be driven to peak output levels. By increasing the placement between face emitting devices for a given substrate, the devices may be driven harder increasing the brightness of the pixel.

In the preferred embodiment of the present invention, [each face emitting EL device is used for imaging a single pixel and the face emission electroluminescent devices are staggered. Preferably, the electrodes of the EL devices are staggered such that the first thin film electrode layers of a first subset of the plurality of layer stacks are aligned along a first line and the first thin film electrode layers of a second subset of the plurality of layer stacks are aligned along a second line. The first line is a predetermined distance from the second line, and the predetermined distance should be large enough to prevent any area overlap of the thin film electrode layers in the first subset with the thin film electrode layers of the second subset. Staggering the array layout provides increased area to build the printhead structures including the emitting pixels, optical structures, electrical interconnect, surface mount sites, etc.

The planar surface of the light emitting surface allows for easier incorporation of integrated optical structures such as micro lenses or other light collection structures. In edge emitting devices, incorporation of integrated optical structures is difficult since the ledge and overall geometry of the device interferes with the placement of an integral lens and the linear array precludes the use of certain lens designs. It is believed that integrated optical structures are more efficient light collection structures. In one embodiment, the light collection structure formed on the surface of the layer stack is a tubular structure having an external surface and an internal surface, where the internal surface is reflective. The first end of the structure has a first area A1, and the second end of the structure has an area A2, where the second area A2 is less than the first area A1. The first end of the structure, the widest end, is mechanically coupled to the surface of the layer stack. Applicant believes this type of structure can be used to increase the power per unit area delivered to the recording media.

A further understanding of the nature and advantages of the invention described herein may be realized by reference to the remaining portions of the specification and the attached drawings.

DETAILED DESCRIPTION OF THE PREFERRED EMBODIMENTS

Figure 2A:
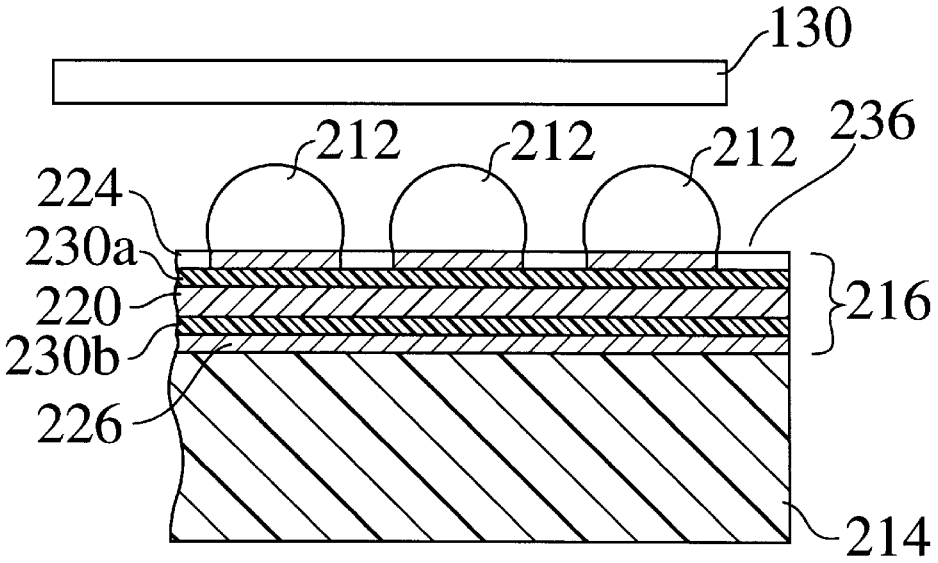
FIG. 2A shows a partial side cross-sectional view of a staggered face emitting EL printing system with integral micro lenses according to one embodiment of the present invention.

Referring to FIG. 2A shows a cross-sectional view of an array 200 of face emission electroluminescent device 210 according to the preferred embodiment of the present invention. optically coupled to an optical structure 212. The array of face emission electroluminescent devices are comprised of a substrate 214; and a plurality of layer stacks 216 supported on the substrate 214, each of the plurality of layer stacks 216 including a thin film active layer 220 which generates light in response to conduction of electrical current, a first thin film electrode layer 224 and a second thin film electrode layer 226, where at least one of said electrode layers (224, 226) is spaced apart from said thin film active layer 220 by a thin film dielectric layer 230. The first thin film electrode layer 224 is transparent and light is emitted through the surface of the first thin film electrode layer 224, in contrast to standard edge emitting device which light is emitted primarily from the edge perpendicular to the first and second film electrodes 224, 226. Typically, the emitted light is optically coupled to an optical structure 212, the optical structure 212 preferably being formed on an emitting surface 236 of the plurality of layer stacks 216.

The plurality of electroluminescent devices 210 are formed on a substrate 214 which is typically glass. Although only a single dielectric layer is required, typically the thin film active semiconductor layer 220 is sandwiched between a first dielectric layer 230*a* and a second dielectric layer 230*b*. An acceptable material for forming the active semiconductor layer 220 is zinc sulfide doped with manganese. The dielectric layers 230*a*, 230*b* are typically be silicon oxinitride, but other materials may be selected.

The active layer 220 and first and second dielectric layers 230*a*, 230*b* are positioned between a first and second electrode layers 224, 226. The electrode layers are typically formed of indium tin oxide (ITO) but may be formed of other materials. ITO is an electrically conductive, optically transparent material. Although the second electrode 226 may be opaque to the wavelength of light emitted, it is required that the first electrode 224 be transparent to the light being emitted, since in the face emission device light is emitted from the surface of the first electrode 224.

A drive signal 240 is connected across electrode layers 224 and 226. Typically, the electroluminescent device is driven by an alternating current drive signal. Electroluminescent occurs in the active semiconductor layer when electrical current is passed through the semiconductor layer. The electrical current excites the electrons of the dopant material. The selection of the material and dopant concentration for forming the active semiconductor layer determines the frequency of the light emitted.

In the embodiment shown in FIG. 2A, the optical structures 212 coupled to the face emitting EL layer stacks are micro lenses. The micro lenses 212 are formed on the emitting surface of the face emission devices so that they are integral to the face emission devices. The planar surface of the light emitting surface of the face emission array allow for easy incorporation of integrated optical structures such as micro lenses or other light collection structures. It is believed that integrated optical structures formed integral to the emitting surface of the face emission devices are more efficient light collection structures.

Forming conventional lenses on the surface of an edge emitting EL device is not practical due to the space restrictions of the EL device. The edge emitting devices are formed in a row, and placement of the sweet spot of conventional lenses directly over the pixel would result in overlapping lens edges since the edge emitting devices must be closely spaced. Further, as previously stated, use of a conventional lens to encompass all of the edge emitting pixels would impose unacceptable size requirements on the printhead. Use of a face emission array of devices increases the amount of area available for placement of the emitting region since the area available for placement of the emitting regions of the plurality of face emitting stacks is restricted only by the surface area of the substrate. This is in comparison to the much smaller area available for placement of emitting regions for edge emitting devices. This additional area can be used to separate pixels or pixel groups so that optical systems can be integrally coupled to the face emission devices without the deleterious effects which would occur in edge emitting devices.

Figure 2B:
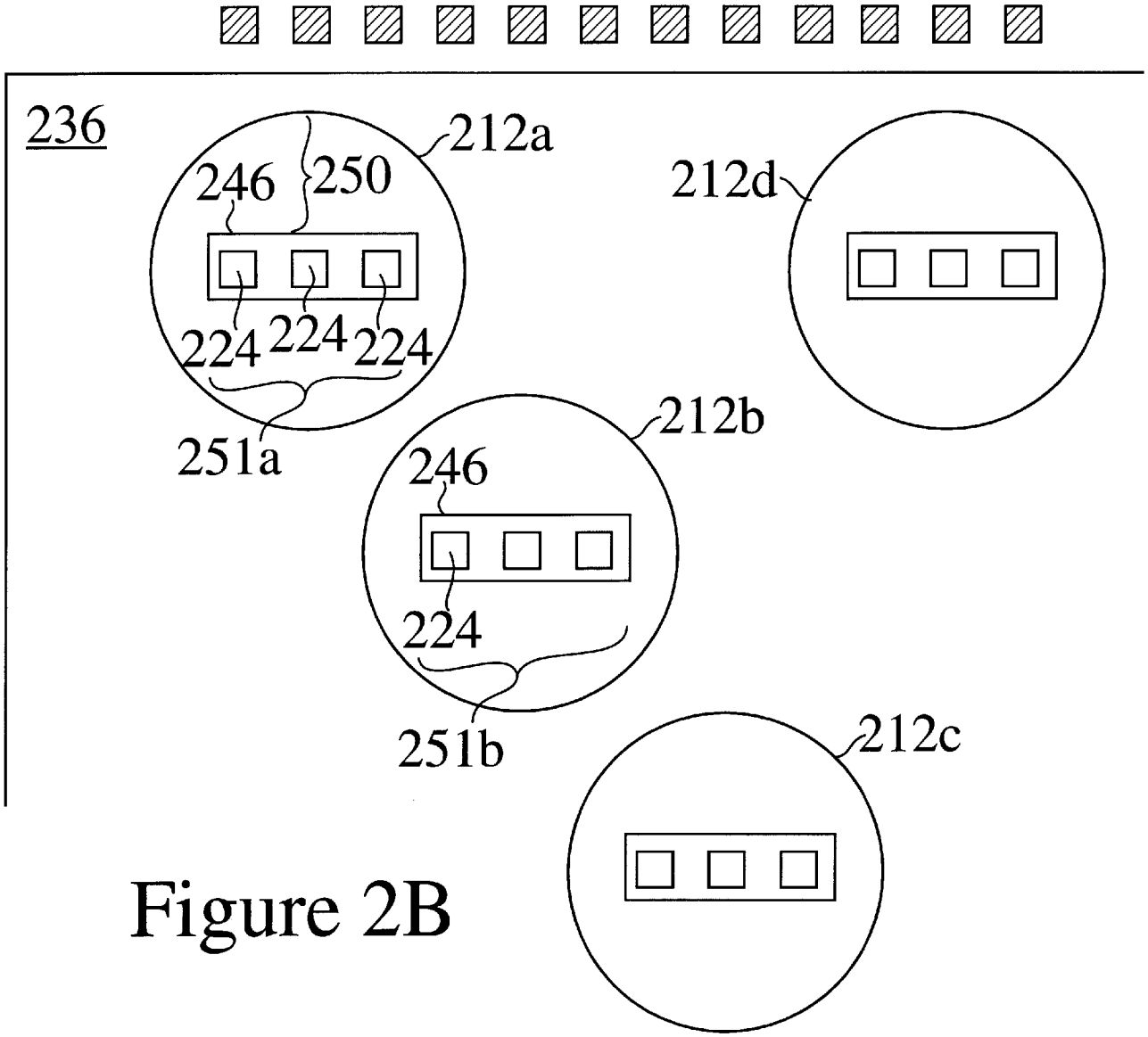
FIG. 2B shows a top view of a face emission EL printing system wherein the face emitting EL devices are staggered according to the one embodiment of the present invention.

As can be seen in FIG. 2B, a subset 244 of the plurality of layer stacks 216 is optically coupled to a micro lens 212. FIG. 2B shows a top view of a face emission EL printing system wherein the face emitting EL devices are staggered according to the one embodiment of the present invention. The sweet spot of the micro lens is represented by the boundary 246. The outermost perimeter of the micro lens 212 formed on the emitting surface of the array 220 is represented by the boundary 248.

The micro lens 212 is positioned on the emitting surface of the face emitting array and is positioned such that the sweet spot 246 of the micro lens 212 is centered over electrodes 224 of a the plurality of layer stacks 216. As can be seen in FIG. 2B, in order to position the sweet spot of the lens over the first electrode layer 224 of the subset of layer stacks 216, a first portion 250 of the micro lens extends past the boundary of the sweet spot. This first portion 250 of the micro lens is the area outside of the sweet spot of the lens. The first portion would result in optical distortions or lens overlap in a conventional edge emitting array. In edge emitting arrays where EL pixels must be closely spaced, allowing space between layer stacks so that no layer stack would be positioned underneath the first portion of the microlens will result in the absence of properly resolved pixels along the printed row. Further, an unacceptable result would be the absence of pixels along the printed row. In contrast, in the face emission arrays there is sufficient area for placement of the emitting regions that the emitting regions can be positioned so that the first portion of the microlens do not overlap or interfere with each other.

Figure 1:
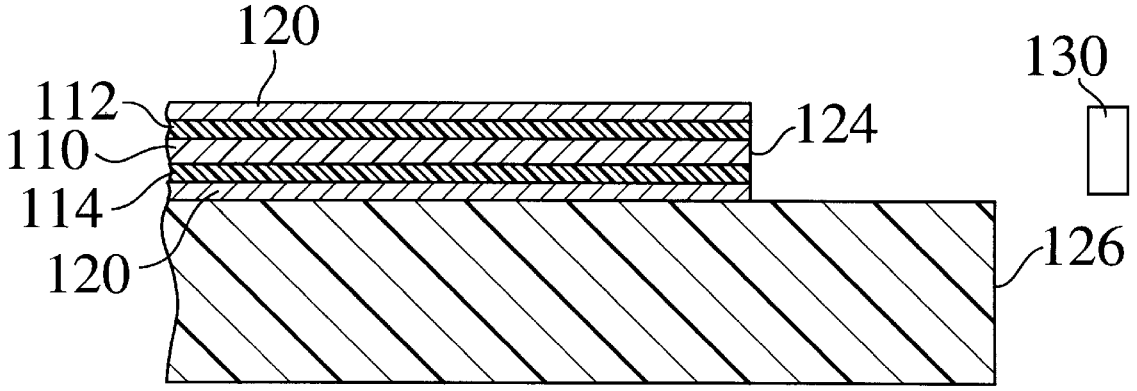
Figure 1 (PRIOR ART)
FIG. 1 shows cross-sectional view of a conventional edge emission electroluminescent device.

Micro lenses 212 are made using techniques well known in the art and are typically molded from a transparent material. The micro lens 212 is typically adhered to the emitting surface of the layer stack so that it is integral to the array of EL devices. The microlens is centered over a plurality of layer stacks. The number of layer stacks 216 positioned underneath the micro lens may vary and may even be one. Preferably, the layer stacks are staggered as shown in FIG. 1. In addition, addressing of the staggered layer stacks is multiplexed so that a single row of print is formed.

The optical structures 212 are formed integral to the emitting surface. Although in the embodiment shown in FIG. 2A and 2B, the optical structure 212 is formed on the surface of the first electrode, alternatively an intermediate layer or layers may be formed on the surface of the first electrode. In this case, the optical structure is formed on the surface of the uppermost intermediate layer.

Referring to FIG. 2B, shows a preferred embodiment of the present invention where the face emission electroluminescent devices are staggered. Preferably, the electrodes of the EL devices are staggered such that the first thin film electrode layers of a first subset 251*c* of the plurality of layer stacks 216 are aligned along a first line and the first thin film electrode layers of a second subset 251*b* of the plurality of layer stacks 216 are aligned along a second line. The first line is a predetermined distance from the second line, and the predetermined distance should be large enough to prevent any area overlap of the thin film electrode layers in the first subset with the thin film electrode layers of the second subset.

Referring to FIG. 2B, each layer stack 216 is directed towards imaging a single pixel. Each layer stack 216 can be defined by a first position $x_i$ and a second position $y_j$. In the preferred embodiment, the layer stacks are not aligned immediately behind one another in the y direction. Thus, in the preferred embodiment, the emitting area of each layer stack positioned at position $x_i$ has a unique position $y_j$. In the case of the emitting structures shown in FIG. 2B, the emitting area is defined by the intersection of the first and second electrodes.

Referring to FIG. 2B shows a top view of staggered face emission devices that are optically coupled to a series of micro lens structures. Although in the preferred embodiment the staggered pixels are optically coupled to integral lens systems such as a micro lens or optical concentrator structure, the staggered layer stacks may be alternatively be coupled to a conventional lens system such as a Selfoc lens array without a micro lens or optical concentrator structure. Further, the staggered pixels may be optically coupled to both an integral lens system and a conventional lens system.

Although the embodiment shown in FIG. 2B shows groups of three layer stacks in each subset 250 of devices, the number of layer stacks grouped beneath a single optical structure may vary from 1 to n. In one embodiment, the number of layer stacks 216 grouped underneath a single micro lens is ten and the predetermined distance separating the first and second subsets 250 is 200 microns. The number of subsets of layer stacks in a row and the number of rows may vary. Further, although the predetermined distance between subsets of layer stacks may vary, it is preferred that the distance between subsets of layer stacks be equal and further it is preferred that the subsets of layer stacks be generally parallel to the width of the printing medium.

Figure 3A:
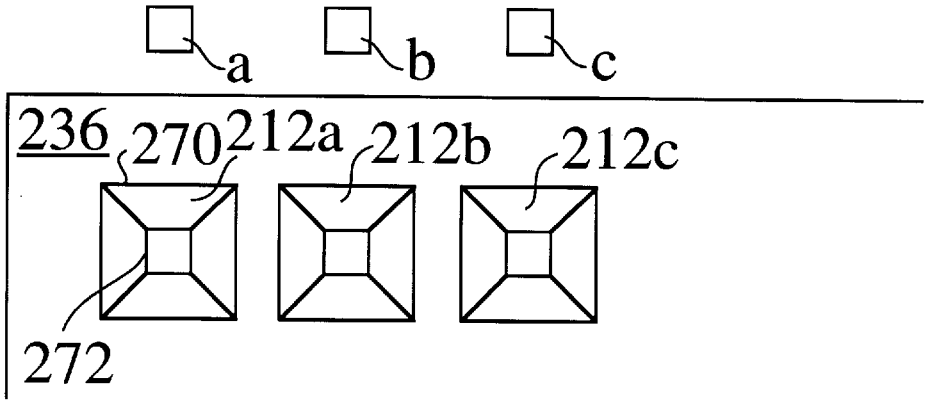
FIG. 3A shows a top view of an integral light concentrator used in a face emission EL printing system according to an alternative embodiment of the present invention.
Figure 3B:
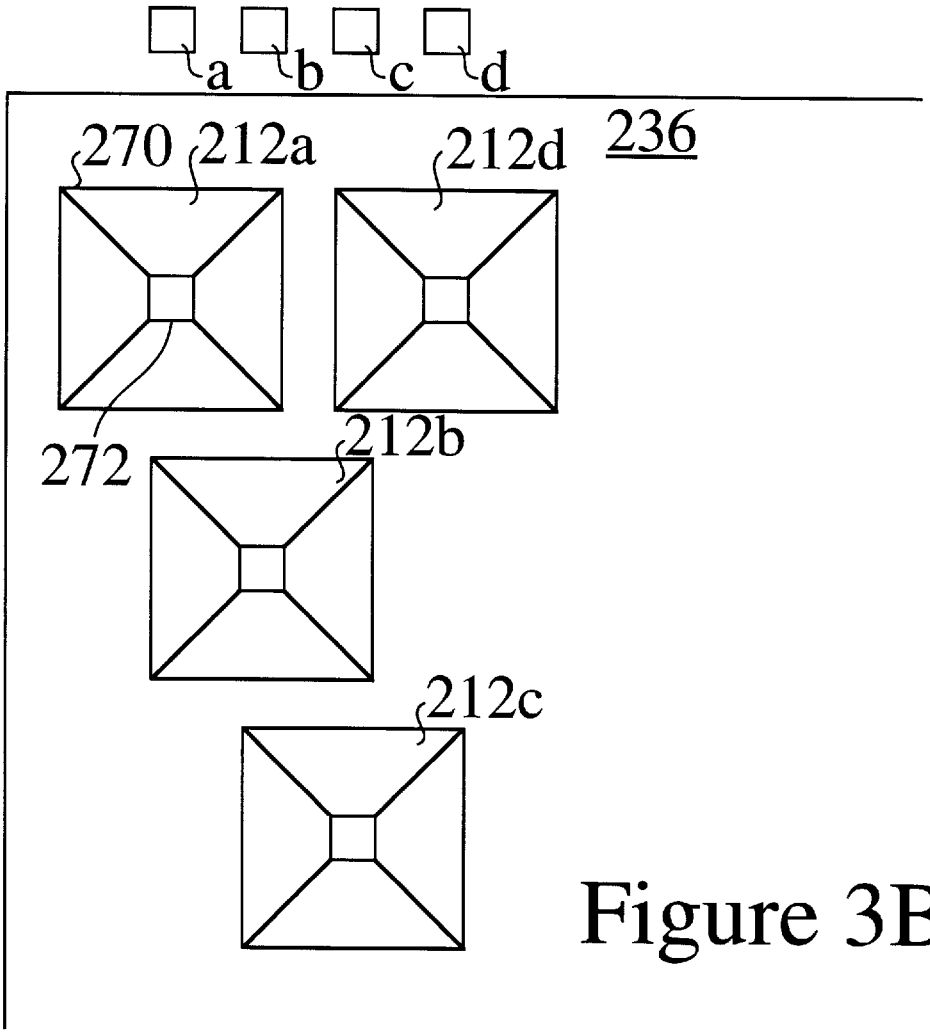
FIG. 3B shows a top view of an integral light concentrator used in a face emission EL printing system where the light concentrators are staggered.

FIGS. 3A and 3B show an alternative embodiment, where the optical structure 212 integrally coupled to the layer stack is an optical concentrator. The optical concentrator 212 shown in FIGS. 3A and 3B are non-imaging optic structure for concentrating the light emitted from the surface of the EL device into a smaller area. In one embodiment, the optical structure 212 formed on the emitting surface of the face emitting device is a tubular structure. The optical structure may be tapered so that a first end of the structure has a first area 270, and a second end of the structure has an area 272, where the second area 272 is less than the first area 270. In the case of the emitting structure shown in FIGS. 3A and 3B, the emitting area of the EL device is the area 272. The first end of the structure, the widest end, is mechanically coupled to the surface of the layer stack. In one embodiment, the optical concentrator has an external surface and an internal surface, where the internal surface is reflective.

In an alternative embodiment of the optical concentrator, the optical concentrator is a tapered structure comprised of a solid material, such as an acrylic material. The solid structure may be coated with a reflective layer, to reflect light generated from the face emitting EL device.

The embodiment shown in FIG. 3B shows a top view of a plurality of integral light concentrator used in a face emission EL printing system where the light concentrators are staggered. Comparing FIG. 3B to FIG. 3A, the staggered arrangement of optical concentrators 212 in FIG. 3B produce a larger number of pixels in a given area, thus increasing the pixel density. Further, the area 270 of the optical concentrators in FIG. 3B is larger than in FIG. 3A. If the area 270 is defined in both FIGS. 3A and 3B by the intersection of the first and second electrodes, Applicant believes that the optical concentrator in FIG. 3B outputs a brighter pixel.

The tapered optical concentrator design is believed to be more optically efficient than a straight walled edge emitter design that is presently proposed for the edge emitter in the case entitled "Capped Edge Emitter", filed on Oct. 27, 1994, having Ser. No. 08/330,152. A tapered collector/concentrator could also be designed for the present edge emitter. This assumes that multiple fraction count pixel density arrays are used to provide enough space to build the tapered collectors shown here.

It is understood that the above description is intended to be illustrative and not restrictive. The scope of the invention should therefore be determined not with reference to the above description, but instead should be determined with reference to the appended claims, along with the full scope of equivalents to which such claims are entitled.

What is claimed is:

1. A face emission electroluminescent printhead comprising:

a substrate;

a plurality of layer stacks supported on the substrate, each layer stack including an emitting surface and a thin film active semiconductor layer which generates light in response to conduction of electrical current, a first thin film electrode layer and a second thin film electrode layer, at least one of the electrode layers being spaced apart from the active layer by a thin film dielectric layer, the first thin film electrode layer being transparent to the generated light, such that a portion of the light generated is emitted through the first thin film electrode layer, wherein the layer stacks are staggered so that an emitting area of each layer stack having a position $x_i$ has a unique position $y_j$; and an optical structure for collecting light emitted through the first thin film electrode of at least one of the plurality of layer stacks, wherein the optical structure is formed on the emitting surface of at least one of the plurality of layer stacks, and wherein the optical structure is a light concentrating means, wherein said light concentrating means has a tubular structure, the tubular structure having a first end and a second end, and an external surface and an internal surface, wherein the internal surface is reflective.

2. The face emission printhead recited in claim 1 wherein the plurality of layer stacks comprise a first subset of the plurality of layer stacks and a second subset of the plurality of layer stacks and wherein the first thin film electrode layers of a the first subset of the plurality of layer stacks are aligned along a first line and the first film electrode layers of a the second subset of the plurality of layer stacks are aligned along a second line, the first line being a predetermined distance from the second line, the predetermined distance being large enough to prevent any area overlap of the first subset of thin film electrode layers with the second subset of thin film electrode layers.

3. The face emission printhead recited in claim 2 wherein the first line is parallel to the second line.

4. The face emission printhead recited in claim 2 wherein the plurality of layer stacks is addressed by multiplexing.

5. The face emission printhead recited in claim 1 wherein the optical structure is formed on the surface of the layer stack.

6. The face emission printhead recited in claim 1, the first end of the tubular structure having a first area A1, the second end of the structure having a second area A2, wherein the second area A2 is less than the first area A1, the first end of the structure being mechanically coupled to the surface of the layer stack.

7. A face emission electroluminescent printhead comprising:

a substrate;

a plurality of layer stacks supported on the substrate, each layer stack including an emitting surface and a thin film active semiconductor layer which generates light in response to conduction of electrical current, a first thin film electrode layer and a second thin film electrode layer, at least one of the electrode layers being spaced apart from the active layer by a thin film dielectric layer, the first film electrode layer being transparent to the generated light, such that a portion of the light generated is emitted through the first thin film electrode layer; and an optical structure for collecting light emitted through the first thin film electrode layer, the optical structure being formed integral to the emitting surface of at least one of the plurality of layer stacks, wherein said optical structure is a light concentrator, wherein said light concentrator has a tubular structure, the tubular structure having a first end and a second end, and an external surface and an internal surface, wherein the internal surface is reflective.

8. The face emission electroluminescent printhead recited in claim 7 wherein each layer stack is staggered so that an emitting area of each layer stack having a position $x_i$ has a unique position $y_j$.

9. The face emission printhead recited in claim 7 wherein the plurality of layer stacks comprise a first subset of the plurality of layer stacks and a second subset of the plurality of layer stacks, and wherein the first thin film electrode layers of the first subset of the plurality of layer stacks are aligned along a first line and the first film electrode layers of the second subset of the plurality of layer stacks are aligned along a second line, the first line being a predetermined distance from the second line, the predetermined distance being large enough to prevent any area overlap of the first subset of thin film electrode layers with the second subset of thin film electrode layers.

10. The face emission printhead recited in claim 9 wherein the first line is parallel to the second line.

11. The face emission printhead recited in claim 9 wherein the plurality of layer stacks is addressed by multiplexing.

12. The face emission printhead recited in claim 17, the first end of the tubular structure having a first area A1, the second set of the structure having a second area A2, wherein the second area A2 is less than the first area A1, the first end of the structure being mechanically coupled to the surface of the layer stack.

* * * * *

UNITED STATES PATENT AND TRADEMARK OFFICE

CERTIFICATE OF CORRECTION

PATENT NO. : 5,835,119
DATED : November 10, 1998
INVENTOR(S) : Brian C. Samuels

It is certified that error appears in the above-identified patent and that said Letters Patent is hereby corrected as shown below:

Column 8,
Line 45, delete “of a the” and insert therefor -- of the --
Line 46, after “of” delete “a”

Column 10,
Line 1, delete “claim 17” and insert therefor -- claim 7 --

Signed and Sealed this

Eleventh Day of May, 2004

JON W. DUDAS
*Acting Director of the United States Patent and Trademark Office*